United States Patent [19]

Lyemance

[11] 4,165,679

[45] Aug. 28, 1979

[54] CHIMNEY DAMPER ARRANGEMENT

[76] Inventor: Bentford C. Lyemance, 4501 Sedgefield Ct., Louisville, Ky. 40216

[21] Appl. No.: 824,977

[22] Filed: Aug. 15, 1977

[51] Int. Cl.[2] ..... F23L 17/02

[52] U.S. Cl. ..... 98/59; 98/85; 126/286; 220/264

[58] Field of Search ..... 98/59, 42, 85, 86, 2.14; 126/286; 49/390; 220/262, 263, 264

[56] References Cited

U.S. PATENT DOCUMENTS

| | | | |
|---|---|---|---|
| 1,494,290 | 5/1924 | Ruhmann | 98/59 |
| 1,654,855 | 1/1928 | Bastien | 98/85 |
| 2,856,839 | 10/1958 | Soderberg | 98/59 |
| 3,377,939 | 4/1968 | Sailors | 98/59 |
| 3,945,307 | 3/1976 | Lyemance | 98/59 X |

*Primary Examiner*—Wiliam F. O'Dea
*Assistant Examiner*—Harold Joyce
*Attorney, Agent, or Firm*—Edward M. Steutermann

[57] ABSTRACT

The present invention provides a new and useful safety arrangement for use in a pivotable chimney damper including a damper flap to selectively open and close the outlet from the flue of a chimney. The damper flap is advantageously pivoted to and includes bias means to urge the damper flap to a normally open position with respect to the frame when unrestrained and carried closure means, which can include flexible pull means to be attached at a first location to the damper flap to pull the damper flap to a closed position against the frame member when the pull means is drawn tight where the pull means can be secured to hold the damper in closed position. An expansible spring means is attached between the damper flap and the pull means to be pulled to extended position when the damper flap is closed. In accordance with the present invention a flexible connector is joined to the pull means at a location below the spring means and the damper flap at a second location where pulling the connector urges the damper toward open position where the length of the flexible connector is such that upon selected extension of spring means the flexible connector becomes taught and the force exerted on the second location is in excess of the force exerted on the first location so the damper flap is urged toward open position.

3 Claims, 3 Drawing Figures

CHIMNEY DAMPER ARRANGEMENT

BACKGROUND OF THE INVENTION

It is well known that open chimney flues present opening for unwanted admission of rain, insects, animals, and birds to homes or other buildings. Further it is well known that significant heat loss occurs through open chimney flues during the winter when a damper or other means is not provided to close off the chimney opening when there is not fire in the associated fireplace.

Various means have been provided for closing a chimney or flue when not in use such as the well known fire box damper, and various other prior arrangements. Some such prior arrangements are illustrated in U.S. Pat. No. 2,704,502, Rainey; and U.S. Pat. No. 2,856,839, Soderberg, as well as U.S. Pat. No. 3,267,832, Hinkle.

Such prior arrangements have certain disadvantages and it is an object of the present invention to overcome many of the difficulties encountered in the use of the prior art arrangements.

Specifically, such previous arrangements have permitted wind blown rain to enter the chimney even though the damper located at the top of the chimney is closed. Moreover in most such arrangements it has been provided for the damper to be normally closed so that when the means to secure the damper are not functioning the damper is in a closed position and if a fire is built in the fireplace, when the damper is closed, the associated rooms are filled with smoke.

In an arrangement shown in U.S. Pat. No. 3,945,307, Lyemance, a normally open damper arrangement is shown to include a sealing arrangement to prevent leakage of rain or snow into the chimney which further provides a seal to reduce heat loss from the chimney. It has been found that such normally open dampers, which provide safety features that the damper normally fails to open freezing rain and snow, under severe conditions prevent opening of the damper.

SUMMARY OF THE INVENTION

The present invention provides a damper arrangement to be received by the top of a chimney where a generally rectangular frame is provided defining an opening from the chimney with a damper flap which is pivotably mounted on the frame. Devices in accordance with the present invention prevent wind blown rain from entering the chimney flue and likewise provides straight forward inexpensive damper arrangements where the damper flap is pivotably mounted on the frame member to be retained in a normally opened position so that in the event of failure of the means provided to close the damper flap, or upon release of the retaining means the damper flap moves to an open position and also provide means to open the damper flap when it is frozen closed during cold weather and does not pivot to open position when the associated retaining device is reclosed.

Briefly, the present invention provides a new and useful safety arrangement for use in a pivotable chimney damper to selectively open and close the outlet from the flue of a chimney where the damper includes an open frame of substantially rectangular shape to be received on the top of the chimney defining an outlet opening from the chimney flue where a damper flap is cooperatively and pivotably carried by the frame where the flap is formed with a periphery substantially identical to the periphery of the frame to engage the frame when the damper is pivoted to the closed position, to prevent air and water from flowing into the chimney. The damper flap is advantageously pivoted to and includes bias means to urge the damper flap to a normally open position with respect to the frame when unrestrained and carries closure means, which can include flexible pull means to be attached at a first location to the damper flap to pull the damper flap to a closed position against the frame member when the pull means is drawn taught where the pull means can be secured to hold the damper in closed position. An expansible spring means is attached between the damper flap and the pull means to be pulled to extended position when the damper flap is closed. In accordance with the present invention a flexible connector is joined to the pull means at a location below the spring means and the damper flap at a second location where pulling the connector urges the damper toward open position where the length of the flexible connector is such that upon selected extension of the spring means the flexible connector becomes taught and the force exerted on the second location is in excess of the force exerted on the first location so the damper flap is urged toward open position.

Figure 1:
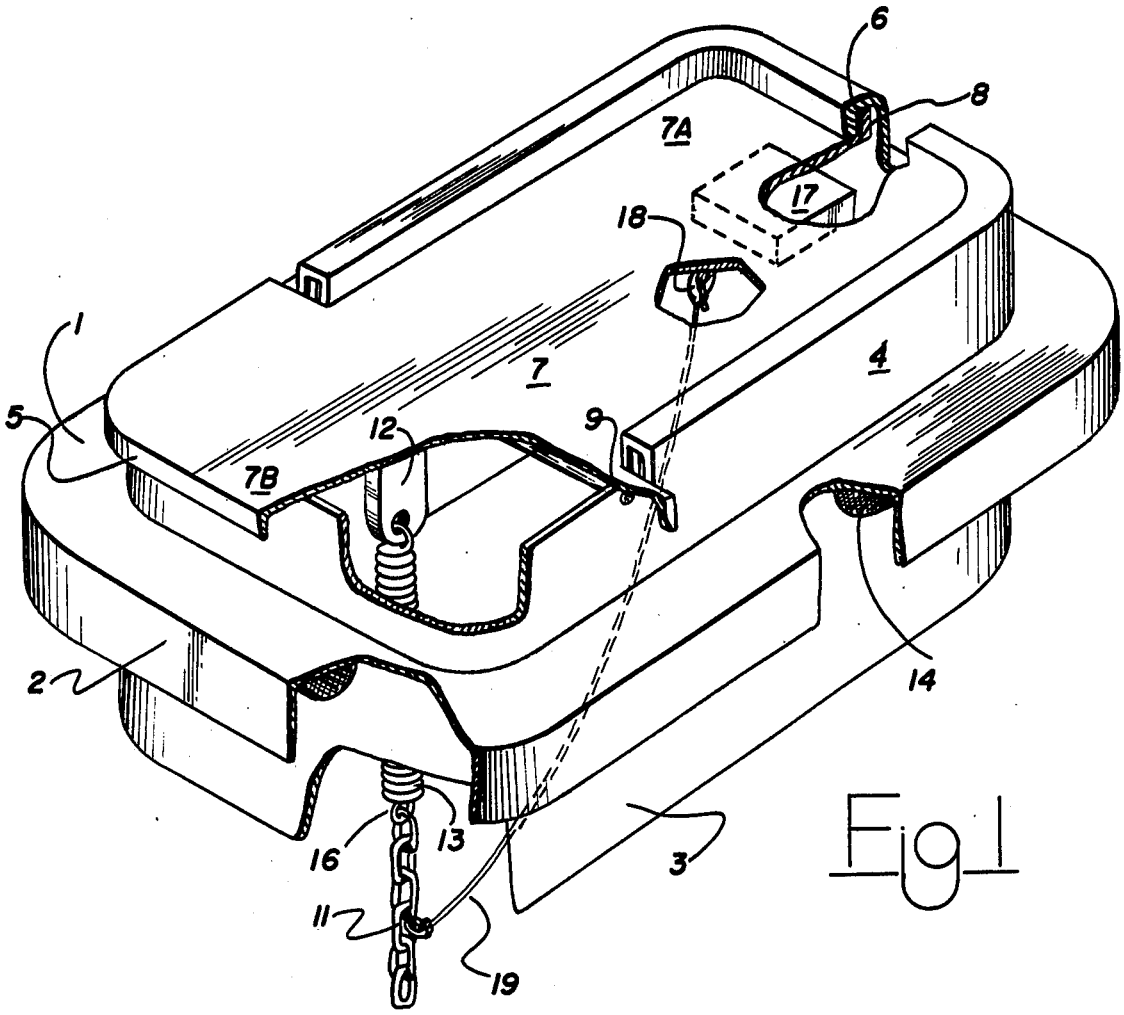
FIG. 1 shows a perspective view partly in section of one example of a damper in accordance with the present invention as described hereinafter.

The example of the present invention shown in the Figure, includes a generally rectangular frame member 1 which is provided to rest on the top at the outlet of the flue of a chimney (not shown) in which the damper arrangement is installed. A depending flange 2 can be provided to extend downwardly from frame 1 over the outer surface of the chimney flue. Frame 1 likewise includes an upstanding generally rectangular flange 4 provided with an inverted channel member 6 at the top edge thereof, which extends partially around the periphery of flange 4 as shown. A sleeve 3 can be provided, as shown, to extend downwardly into the flue liner adjacent the walls of the chimney.

As shown, damper flap 7 is provided to be pivotably mounted in cooperation with flange 4 for example by means of a pivot 9. Pivot 9 is advantageously journaled, for example in flange 7 so that when damper flap 7 is unrestrained, the damper flap is rotatable in a clockwise direction out of engagement with channel 6 to open generally vertical position exposing the opening defined by flange 4 and opening the chimney flue, a weight 17 can be provided to provide additional force tending to open flap 7.

As shown, damper flap 7 includes a downwardly extending lip 5 which can, advantageously extend substantially around a portion of damper flap 7 which extends beyond the limits of flange 4. An upstanding flange 8 is provided around a portion of the periphery of flap 7 to be received in channel 6 to provide a seal between flange 4 and damper 7 extending substantially around flange 4 and the periphery of damper 1 from one end of pivot 9 to the other.

A bracket 12 can be provided on the underside of flap 7 to be connected to a flexible damper pull means, for example a chain 11 by means of an expansible spring 13. Chain 11 extends downwardly through the chimney to fireplace associated with the chimney for closing damper 7 and can be retained therein to hold damper 7 in closed position by latch means (not shown).

Spring 13 is provided to provide a selected tension when chain 11 is pulled after damper 7 is closed, to provide additional bias to hold damper 7 in a closed position and securely fasten damper 7 in sealing relation with flange 4, when chain 11 is pulled to extend spring 13.

Additionally, in accordance with one feature of the present invention, spring 13 also provides means, as described hereinafter to alleviate the force components on damper 7 to release damper 7 where damper flap 7 is frozen or stuck closed.

In accordance with another feature of the present invention a sealing compound 14 can be provided on the underside of frame 1 between flange 2 and sleeve 3 to seal the underside of flange 1 to the top of the chimney to which the apparatus is place. In the alternative bolts (not shown) can be provided to extend through cooperative openings in sleeve 3 and fastened to the chimney flue to secure the damper arrangement in place.

In operation, frame 1 is received on the chimney to which the damper arrangement to be installed, with flanges 2 extending downwardly along the outer surface of the chimney while a sleeve 3 is received by the flue defined within the chimney.

The normally open characteristic can be achieved by locating pivot 9 off center so that the portion 7A of damper flap 7 opposite bracket 12 in portion 7B of damper flap 7 is heavier so that flap 7 pivots about pivot 9, when unrestrained to fall to the open position. If faster or more certain action is desired, a weight 17 can be added to portion 7B of flap 7 to accentuate the off-center character of pivot 9.

Damper flap 7 as previously described is normally open. As previously discussed, damper flap 7 is closed by pulling connector 11 and fastening to suitable fastener means and which is located within the fire box in the fireplace (not shown).

As further previously described, connector 11 can then be pulled further to extend spring 13 to provide a resultant force urging damper flap 7 into closed position.

Upon release of chain 11 damper flap 7 is then rotated by gravitational force, resulting from the location of pivot 9 to an open position extending generally vertically into collar 3 and the chimney flue so that the flue is open and ready for use. It will be noted that in the event spring 11 breaks damper flap 7 will always "fail safe" by rotating to an open position so that the chimney is available for use. In arrangements where the damper is opened by pulling a chain or similar means considerable difficulty is experienced when the chain breaks so the damper return to normally closed position. Extreme difficulties arise when the opening means break after a fire is already set in the associated fireplace.

In the event water accumulates on the upper surface of flange 7 and freezes damper flap closed, or if accumulation of foreign material around the edge of damper flap 7 which causes the damper to stick chain 11 can be drawn to extend spring 13.

Figure 2A:
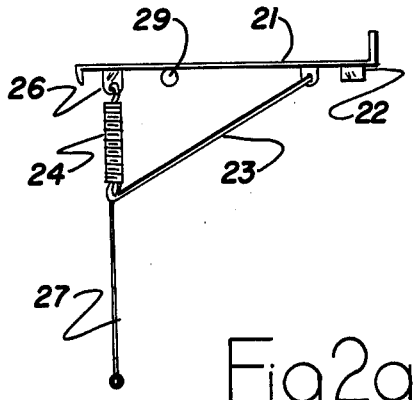
FIGS. 2A–2B, present a schematic illustration of operation of the arrangement shown in FIG. 1.
Figure 2B:
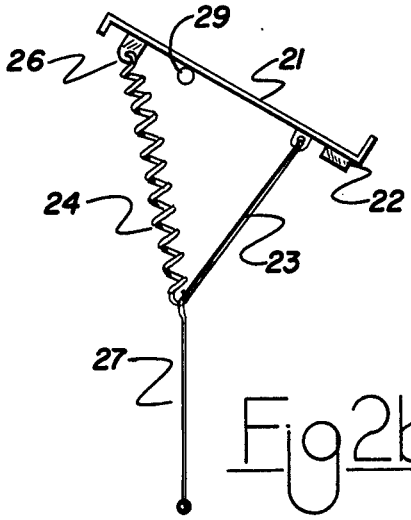

In accordance with one feature of the present invention, as illustrated in FIG. 2B, when damper flap 21 is stuck closed so that it does not open by gravity chain 27 is pulled to extend spring 24, so connector 23 is pulled taught and the point of application of force by chain 27 moves in and are determined by the length of connector 23 toward an area beneath the center of damper 21 and the portion of the force exerted by chain 27 on connector 23 increases while the force component in spring 24 decreases to the point where the force on connector 23 exceeds that on spring 24 and damper 21 is pulled open.

The invention claimed is:

1. A chimney flue damper and closure arrangement including:

(a) frame means of substantially rectangular shape to be disposed adjacent the outlet from a chimney flue defining an outlet from said chimney flue;

(b) damper flap means pivotably carried by said frame means to rotate from a first position closing said opening defined by said frame means to a second position wherein a first portion of said damper flap means is disposed within said chimney flue and a second portion of said damper flap means is rotated to a position extending outwardly from said frame means so said opening defined by said frame is open to flow of fluid from said chimney flue;

(c) pivot means connected to said damper flap means and said frame means to pivotably connect said damper flap means to said frame means so said damper flap is rotatable between said first position and said second position;

(d) bias means to urge said damper flap means to said second position when said damper is unrestrained;

(e) flexible pull means connected to said second portion of said damper flap to pull said damper flap from said second position to said first position where said flexible pull means is connected to said damper flap by spring means connected a first end to said damper flap and at a second end to said flexible pull means; and (f) flexible connector means connected at a first end to said first portion of said damper means and at a second end to said flexible pull means so that when said damper flap means is in said first position force exerted on said flexible pull means extends said spring means to the point that said flexible connector means is drawn taught to exert sufficient force on said second portion of said damper flap to urge said damper flap toward said second position.

2. The invention of claim 1 wherein:

(a) an underside of said second portion of said damper flap is adapted to engage an outlet edge of said frame means and second portion of said damper flap means extends beyond the periphery of said portion of said frame means engaged by said second portion of said damper flap means; and (b) said second portions of said damper flap includes downwardly extending lip means around a portion of said second portion of said damper flap.

3. The invention of claim 1 wherein said first portion of said damper flap means is heavier than said second portion of said damper flap means so said first portion of said damper flap, when unrestrained rotates about said pivot means to open the opening defined by said frame means.

* * * * *